United States Patent [19]

Schultes et al.

[11] 4,420,149

[45] Dec. 13, 1983

[54] AUTOMATIC ORIGINAL DOCUMENT FEEDER FOR ELECTROPHOTOGRAPHIC COPIER

[75] Inventors: Max Schultes, Old Tappan, N.J.; Dietmar Eberlein, Wappingers Falls, N.Y.

[73] Assignee: Savin Corporation, Stamford, Conn.

[21] Appl. No.: 265,393

[22] Filed: May 20, 1981

Related U.S. Application Data

[63] Continuation-in-part of Ser. No. 97,554, Nov. 26, 1979, abandoned, which is a continuation-in-part of Ser. No. 7,370, Jan. 29, 1979, abandoned.

[51] Int. Cl.[3] ..... B65H 1/04; B65H 3/06

[52] U.S. Cl. ..... 271/10; 221/188; 221/209; 271/4; 271/9; 271/122; 271/162; 355/3 SH; 400/625

[58] Field of Search ..... 271/122, 10, 4, 119, 271/120, 162, 116, 125, 124, 121, 114, 110, 111, 37, 164, 3.1, 9; 355/3 SH, 14 SH; 400/624, 625, 626, 603.1; 221/188, 209

[56] References Cited

U.S. PATENT DOCUMENTS

| | | | |
|---|---|---|---|
| 650,410 | 5/1900 | Morin | 271/125 X |
| 2,104,630 | 1/1938 | Zahn | 271/122 |
| 3,044,770 | 7/1962 | Breuers | 271/122 |
| 3,484,099 | 12/1969 | Gallagher | 271/125 X |
| 3,597,076 | 8/1971 | Hubbard et al. | 271/4 X |
| 3,771,783 | 11/1973 | McInerny | 271/125 |
| 3,776,545 | 12/1973 | White | 271/4 |
| 3,829,083 | 8/1974 | Shiina et al. | 271/186 X |
| 3,869,117 | 3/1975 | Yoshimura | 271/35 X |
| 3,957,366 | 5/1976 | Taylor et al. | 271/164 X |
| 4,015,839 | 4/1977 | McKee | 271/37 |
| 4,023,791 | 5/1977 | Hori et al. | 271/4 X |
| 4,062,533 | 12/1977 | Greenberg et al. | 271/4 X |
| 4,067,566 | 1/1978 | Williams | 271/6 X |
| 4,169,674 | 10/1979 | Russel | 271/3.1 X |
| 4,208,046 | 6/1980 | Shimizu | 271/122 |
| 4,218,128 | 8/1980 | Satomi et al. | 271/4 X |
| 4,231,562 | 11/1980 | Hori | 271/3.1 |

FOREIGN PATENT DOCUMENTS

| | | | |
|---|---|---|---|
| 1966526 | 1/1973 | Fed. Rep. of Germany | 271/162 |
| 2510813 | 9/1975 | Fed. Rep. of Germany . | |
| 1509061 | 4/1978 | United Kingdom . | |

*Primary Examiner*—Bruce H. Stoner, Jr.
*Attorney, Agent, or Firm*—Shenier & O'Connor

[57] ABSTRACT

A document feeder for advancing original documents to the exposure platen of an electrophotographic copier which is capable of operating in either a semiautomatic or fully automatic mode. In the semiautomatic mode, an original to be copied is manually inserted face up into an inlet where it is engaged by the semiautomatic transport assembly inverted and advances to a proper position for copying. After exposure the document is again inverted and guided into a receiving tray overlying the platen. In the automatic mode of operation, a second tray normally maintained in an inoperative position is swung down to a position at which its feed end is adjacent the feeder inlet. Documents to be copied are placed face up as a stack in the second tray, and feed rollers carried by the tray are actuated to advance documents individually from the stack to the inlet. In a preferred embodiment, a driven feed roller is disposed below the retarding roller at a fixed spacing therefrom to feed sheets from the bottom of the stack so that the sheets are collected in the stacking tray in their original order. In the same embodiment, a guide strip having fingers extending between the feed roller and reduced-diameter portions of the retarding roller is resiliently urged into engagement with the feed roller to press the sheet being fed firmly against the roller to ensure reliable feed regardless of sheet thickness.

5 Claims, 7 Drawing Figures

AUTOMATIC ORIGINAL DOCUMENT FEEDER FOR ELECTROPHOTOGRAPHIC COPIER

CROSS-REFERENCE TO RELATED APPLICATIONS

This application is a continuation-in-part of copending application Ser. No. 97,554, filed Nov. 26, 1979, now abandoned which application in turn is a continuation-in-part of application Ser. No. 7,370, filed Jan. 29, 1979, now abandoned.

BACKGROUND OF THE INVENTION

Document feeders for advancing original documents to a proper position for copying on the transparent imaging platen of an electrophotographic copier are well known in the art, being described, for example, in U.S. Pat. No. 3,829,083 issued to Shiina et al, U.S. Pat. No. 3,747,918 issued to Margulis et al, and U.S. Pat. No. 4,129,295 issued to Hori et al.

Recently there have been disclosed automatic document feeders of the "recirculating" type for successively feeding sheets from a stack of originals to the imaging platen of an electrophotographic copier. In one such feeder of this type, disclosed in U.S. Pat. No. 4,078,787, issued to Burlew et al, originals are separated from the bottom of a stack generally overlying the imaging platen, turned around and advanced to the imaging platen at which a single copy is made, and then again turned around and returned to the top of the stack.

While the so-called recirculating document feeders of this type can be used to produce collated sets of copies without any additional sorting step, they have several drawbacks. First, since it is necessary to make one full pass in which each original is recirculated for each set of copies desired, the additional time required to position each document on the imaging platen increases the total copying time.

Other problems arise in the separation of sheets from the stack. In the Burlew et al patent referred to, a vacuum cylinder is used as a sheet separator with its attendant bulk, complexity and requirement for the provision of a vacuum pump. Still other feeders such as disclosed in U.S. Pat. No. 4,231,562 issued to Hori employ a friction feed roller which cooperates with a reversely driven retarding roller for preventing the multiple feeding of sheets. In feeders of this type, the feed roller and elements rotating therewith are usually disposed a fixed distance from the retarding roller and associated elements, the distance being selected so as to permit the passage of only a single sheet between the respective rollers. Because of the fixed separation of the feed-roller and retarding-roller shafts, the performance of the feeder is dependent on the thickness of the sheets being handled, and sheet separation may become unreliable in the case of onionskin or other thin originals.

Finally, completely automatic feeders of the recirculating type have the disadvantage of being overspecialized. That is, the feeders operate most advantageously in the completely automatic mode and are not readily adaptable to operating semiautomatically. The place-marking element usually employed when operating in a recirculating mode also tends to increase the complexity and expense of the overall apparatus.

SUMMARY OF THE INVENTION

One of the objects of our invention is to provide a document feeder for an electrophotographic copier which is readily adapted to operate in either a semiautomatic or a fully automatic mode.

Another object of our invention is to provide a document feeder which is simple and reliable.

Still another object of our invention is to provide a document feeder which does not increase the overall copying time.

A further object of our invention is to provide a document feeder which readily handles sheets of varying thicknesses.

Other and further objects of our invention will be apparent from the following description.

In one aspect, our invention contemplates a document transport apparatus for use with a copier having an exposure platen in which a first assembly having a pair of opposing feed members grips documents introduced into an inlet and transports them to the exposure platen. A second assembly comprising a support for receiving a stack of documents and a sheet separator for automatically advancing documents from the stack off an end of the support is mounted for movement between a first position with the support end adjacent to the sheet inlet for fully automatic sheet-feeding operation and a second position permitting access to the inlet by the operator independently of the sheet separator for semiautomatic sheet-feeding operation.

In another aspect, our invention contemplates a document feeder for an electrophotographic copier having an upwardly facing exposure platen in which documents are automatically advanced from a stack carried by a first support disposed above the exposure platen and transported to the exposure platen with the side originally face up inverted. After exposure the document is transported from the platen to the top of a stack carried by a second support disposed between the first support and the platen with the same side now face up. The first support is inclined relative to the second support in such a manner as to assist in the separation of documents from the stack carried by the first support as well as to provide access to the stack carried by the second support.

In yet another aspect, our invention contemplates a sheet feeder in which a stack of sheets is supported with a sheet of the stack adjacent a friction feed member and a friction retarding member disposed opposite the feed member at a predetermined spacing therefrom. The feed member is driven in such a direction as to separate the sheet from the stack and advance it between the feed and retarding members while a guide member is resiliently urged into engagement with the feed member to urge the sheet against the feed member and thereby ensure its separation from the stack.

BRIEF DESCRIPTION OF THE DRAWINGS

In the accompanying drawings to which reference is made in the instant specification and in which like reference characters are used to indicate like parts in the various views.

DESCRIPTION OF THE PREFERRED EMBODIMENTS

Figure 1:
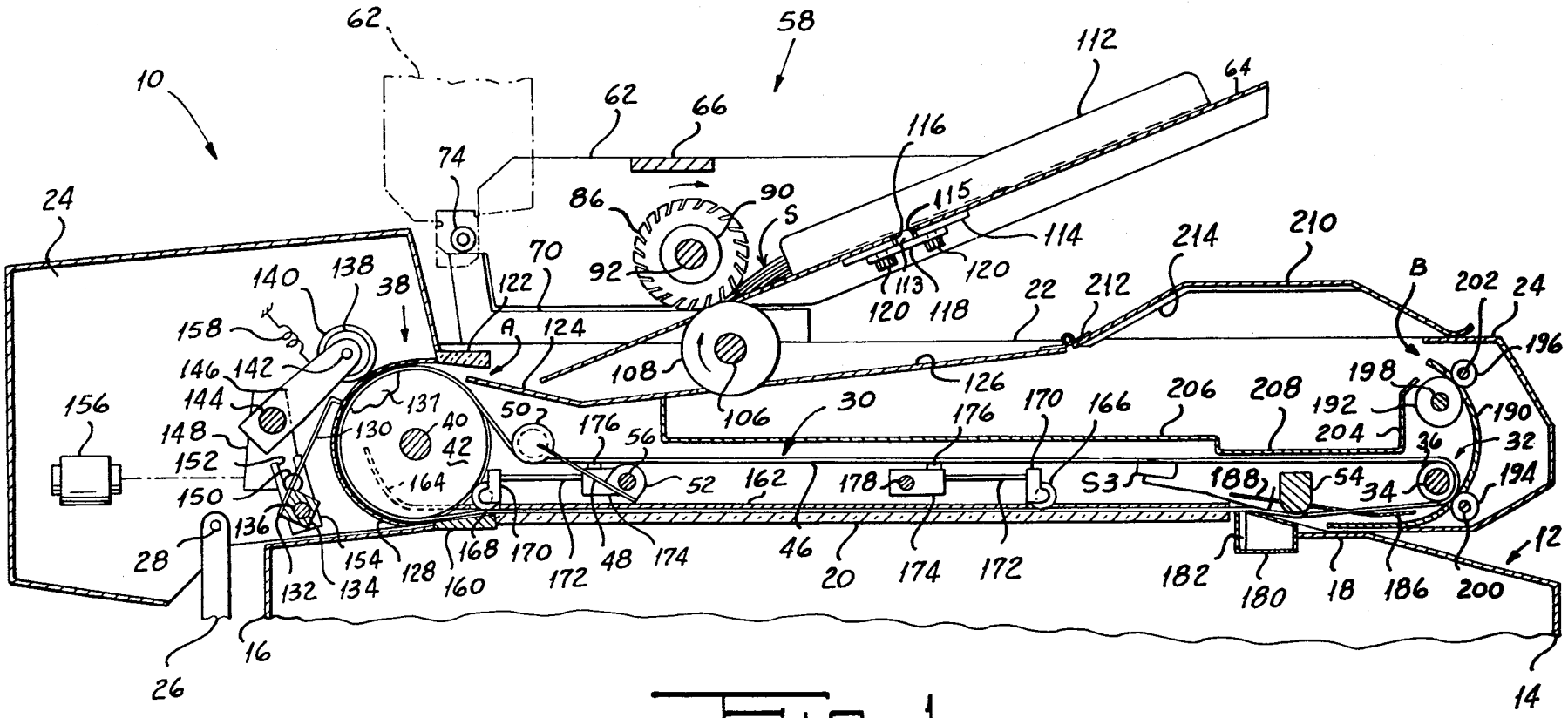
FIG. 1 is a fragmentary section of one embodiment of our automatic document feeder in its operative position on an electrophotographic copier.
Figure 2:
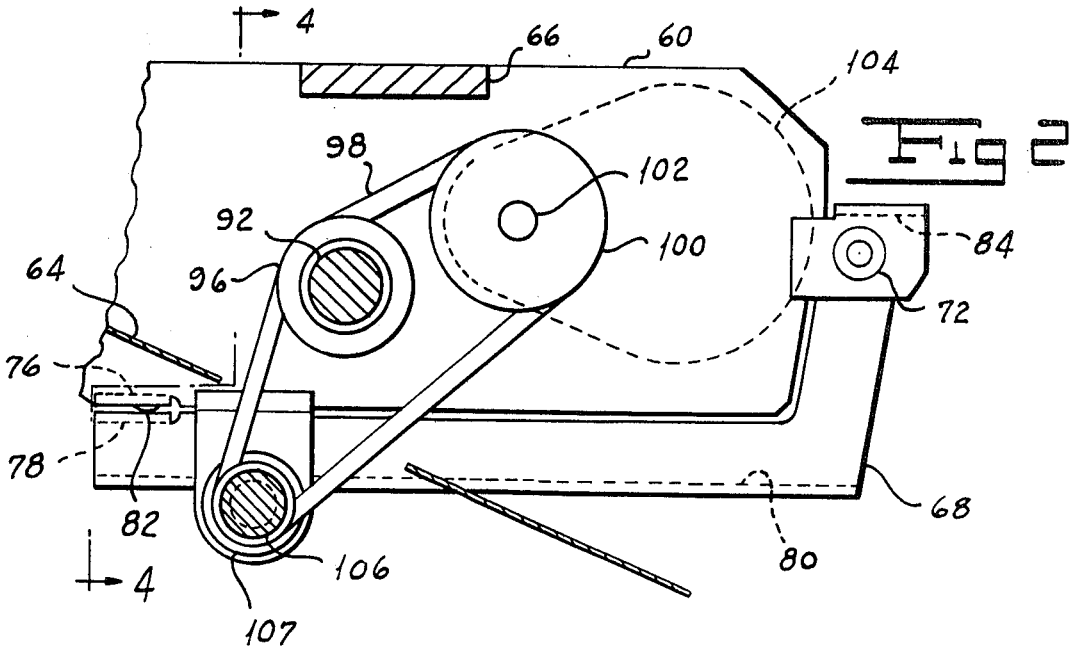
FIG. 2 is an enlarged fragmentary section illustrating the drive train of the feeder shown in FIG. 1.

Referring now to FIGS. 1 to 4, one embodiment of our document feeder, indicated generally by the reference character 10, rests upon an electrostatic copier, indicated generally by the reference character 12, having a front wall 14, a rear wall 16, and an upper wall 18 supporting a transparent exposure platen 20. The feeder frame includes left and right side plates 22 and 23 extending generally parallel to the sides of the copier 12. A pair of left and right rear side plates, one plate 24 of which is shown, are secured to the rear portions of the plates 22 and 23. Brackets 26 on the copier 12 carry pivot pins 28 extending into rear side plates 24 to permit the entire feeder to be swung away from the exposure platen 20 to permit thick originals such as books to be copied. Suitable limit stops (not shown) define a lower limit position in which the feeder 10 is slightly spaced from the copier 12 as shown in FIG. 1.

Figure 3:
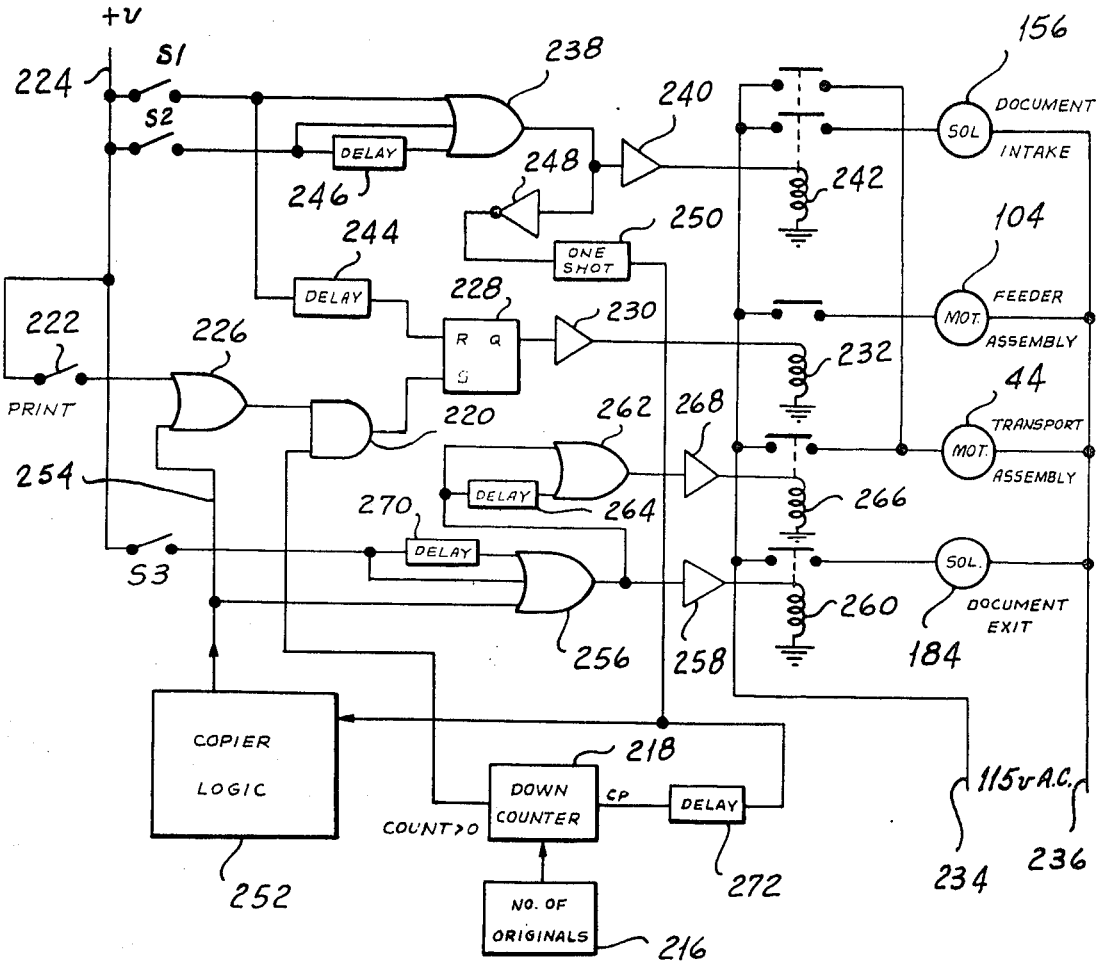
FIG. 3 is a schematic diagram of one form of logic circuit for controlling the feeder shown in FIG. 1.

The transport assembly of the feeder 10, indicated generally by the reference character 30, includes a front pulley assembly, indicated generally by the reference character 32. Pulley assembly 32 comprises a shaft 34 rotatably received by left and right side plates 22 and 23 in front of platen 20 and a plurality of pulleys 36 mounted on the shaft 34 at spaced locations therealong. A rear pulley assembly, indicated generally by the reference character 38, includes a shaft 40 rotatably received by left and right side plates 22 and 23 behind the exposure platen 20 and a plurality of pulleys 42 mounted at spaced locations on the shaft 40. A motor 44, shown schematically in FIG. 3, is intermittently actuated in a manner more fully described hereinbelow to drive shaft 40 in a counterclockwise direction as viewed in FIG. 1.

A plurality of frictional transport belts 46 supported between respective pulleys of the front and rear pulley assemblies 32 and 38 form a conveyor loop. A plurality of flanged tension pulleys 50 provide belts 46 with a suitable amount of tension. Tension pulleys 50 are rotatably supported at ends of resilient metal strips 48, the other ends of which are secured by clamps 52 to a transversely disposed supporting rod 56. A rounded guide bar 54 extending transversely of the feeder at a location between the front edge of the platen 20 and the pulley assembly 32 diverts portions of the belts 46 slightly below the level of the platen 20.

An upper guide 122 and a lower guide 124 formed from the upwardly inclined rear edge of a platform 126 form a document-receiving inlet, indicated generally as A, at the top of the rear pulley assembly 38. If the automatic feeder assembly is not used, documents may be fed manually to the transport assembly 30 by placing them one at a time face up on the platform 126 and moving them rearwardly into the inlet A.

An automatic original removal and delivery assembly, indicated generally by the reference numeral 58, delivers originals individually to the transport belts 46. Assembly 58 comprises a support 64 extending between left and right side plates 60 and 62 and inclined downwardly toward the upper end of rear pulley assembly 38 from the direction of the front pulley assembly 32. A cross bar 66 extends between the upper portions of side plates 60 and 62 to provide additional structural rigidity. Pivots 72 and 74 carried by respective left and right L-shaped brackets 68 and 70 support side plates 60 and 62 for pivotal movement from a normal or operative position shown in solid lines in FIG. 1 to a raised or inoperative position fragmentarily shown in dot-dash lines in the same figure. Brackets 68 and 70 are mounted on respective side plates 22 and 23 of the feeder 10 along the upper edges thereof by means of outwardly extending lower flanges 80. A respective outwardly extending portion 78 at the upper longitudinal edge of each of brackets 68 and 70 abuts a rubber foot 82 carried by an outwardly extending stop 76 on the corresponding side plate 68 or 70 to define a lower or operative position of the pivoting portion of assembly 58. Side plates 60 and 62 are also formed with outwardly extending stops 84 near the pivots 72 and 74 which abut the upwardly extending portions of brackets 68 and 70 when the assembly portion is raised to define an upper limit position.

Figure 4:
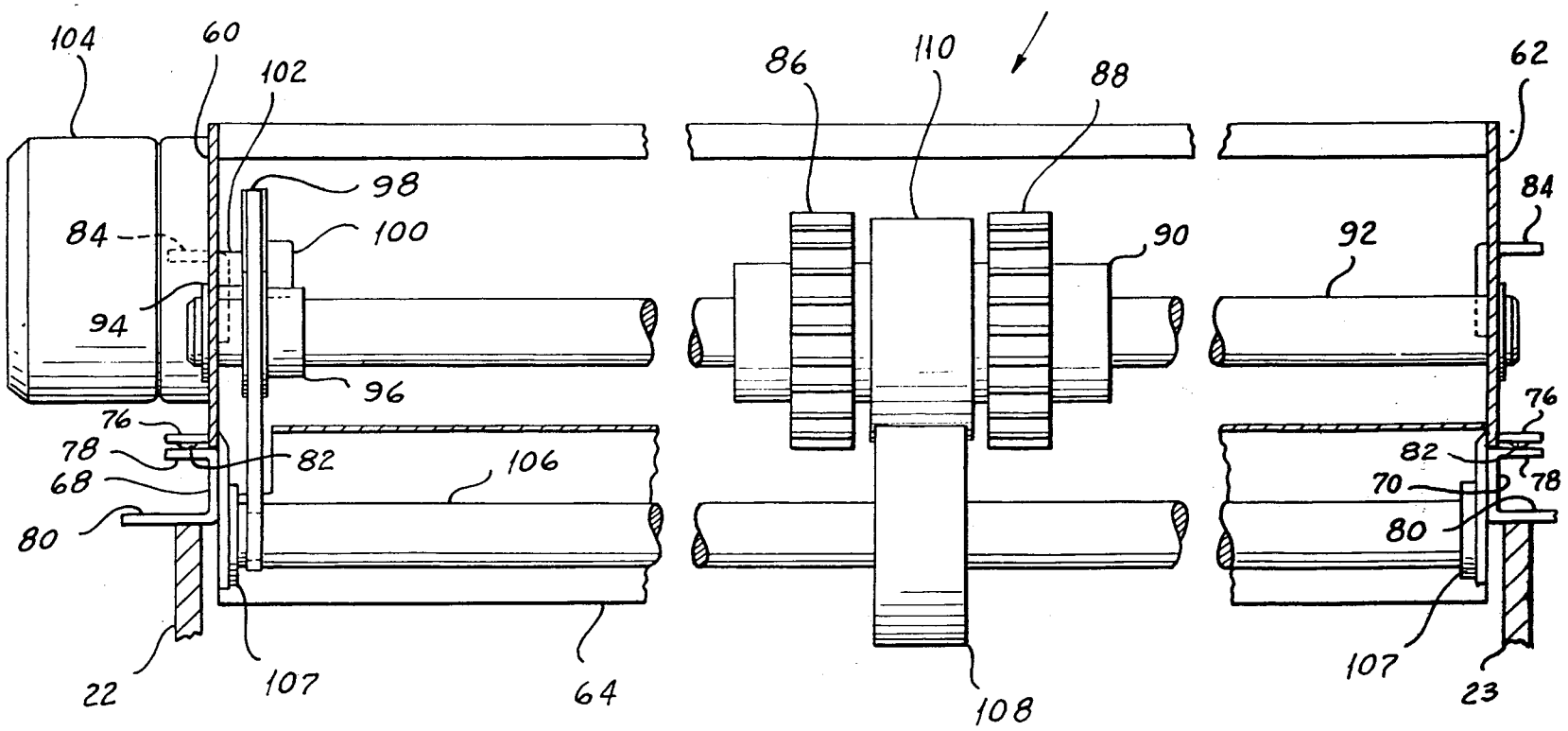
FIG. 4 is a section showing the relative position of the rollers of the drive train of FIG. 2, taken along line 4—4 thereof.

A shaft 92 carried by respective bearings 94 in side plates 60 and 62 supports a pair of axially spaced friction feed rollers 86 and 88 just above the upper surface of the support 64. Preferably, feed rollers 86 and 88 have relatively soft working surfaces and are serrated with the teeth inclined toward the direction of feed as shown in FIG. 1 to provide a more positive gripping action. A one-way clutch 90 mounts rollers 86 and 88 on shaft 92 to permit freewheeling clockwise movement as viewed in FIG. 1. A second shaft 106 mounted in bearings 107 in side plates 60 and 62 below the feed rollers 86 and 88 carries a relatively hard lower retarding roller 108. Lower roller 108, which is positioned axially between feed rollers 86 and 88, extends above the level of support 64 to form a narrow gap with a soft, relatively smooth restriction roller 110 carried by upper shaft 92. As shown in FIG. 4, roller 110 has a somewhat smaller radius than that of rollers 86 and 88 to augment the gripping action of the latter rollers and to "scallop" the sheet being advanced to give it longitudinal rigidity. We space roller 110 at such a distance from retarding roller 108 as to permit the passage of only a single sheet therebetween.

A drive belt 98 carried by lower shaft 106 and by a pulley 96 on upper shaft 92 also extends around a pulley 100 carried by the shaft 102 of a motor 104 mounted outboard of the left side plate 60. Motor 104 is intermittently energized in such a direction as to rotate shafts 92 and 106 in a clockwise direction as seen in FIG. 1 to move the upper rollers 86, 88 in an advancing direction and the lower roller 108 in a retarding direction.

Sheets to be fed are placed face up on the support 64 above the level of rollers 86 and 88 between the right side plate 62 and a longitudinally extending paper edge guide 112. One or more pins 113 extending through a transverse slot 116 in base 64 and through a slot 115 in a plate 114 carried by the underside of base 64 secure a plate 118 to guide 112. This arrangement permits adjustment of the lateral position of the edge guide 112. Screws 120 carried by plate 118 may be tightened to engage plate 114 to secure the edge guide 112 in position.

When an original is to be copied, motor 104 is energized to drive feed rollers 86 and 88 to separate the uppermost original from the stack S and to advance it through the inlet A. The original is then directed around the rear pulley assembly 38 along a transport path defined by a cylindrical guide 128.

A plurality of fingers 130 are selectively moved through suitable openings in cylindrical guide 128 and across the transport path defined by the guide 128 to prevent the original from moving past a predetermined point along its transport path. Fingers 130 are preferably stamped or are otherwise formed from a single sheet 132 of metal or other material, secured to a support 134 carried by a shaft 136.

A plurality of drive rollers 137 mounted on the second pulley assembly shaft 40 at spaced locations from its right end and having a diameter greater than that of pulleys 42 by twice the thickness of belts 46 assist in driving an original around the transport path defined by cylindrical guide 128. Rollers 137 preferably comprise a suitable low-friction material. Rollers 137 cooperate with a plurality of pressure rollers 138 preferably having a somewhat smaller diameter and provided with rubber tires 140 to provide high-friction working surfaces. A shaft 142 supports pressure rollers 138 for common rotation at spaced locations corresponding to the locations of rollers 137. A shaft 144 rotatably supported by side plates 22 and 23 carries a central arm 146 for rotation therewith. Shaft 144 and arm 146 support the pressure roller assembly for swinging movement toward and away from the drive rollers 137. Shafts 142 and 144 and arm 146 are disposed in such a manner as to permit pressure rollers 138 to engage drive rollers 137 along a line between the inlet A and the stop fingers 130. Cylindrical guide 128 is provided with suitable slots to permit engagement of the pairs of rollers 137 and 138.

The pivot shaft 144 carries a crank plate 148 provided with a crank pin 150. The stop finger shaft 136 carries an arm 154 having a slot 152 formed in its end for receiving pin 150. Pivot arm shaft 144 is thus coupled to stop finger shaft 136 in such a manner that movement of the pressure rollers 138 into engagement with the drive rollers 137 is accompanied by a movement of the stop fingers 130 away from the transport path defined by the cylindrical guide 128. The armature of a solenoid 156 is connected by a suitable linkage to crank plate 148 to rotate shaft 144 in a clockwise direction (as seen in FIG. 1) against the action of a spring 158 when the solenoid is energized. Normally, the spring 158 maintains the above-described inlet assembly in a disengaged position, shown in FIG. 1, in which the pressure rollers 138 are disengaged from the drive rollers 137 and originals are prevented from moving further along the transport path by fingers 130. When the inlet assembly is in such a disengaged position, motor 104 may be energized to advance an original through the inlet A.

The feeder assembly 58 continues to advance the original along the transport path until its leading edge is beyond the pressure rollers 138. At this point, motor 104 is disabled and motor 44 is actuated to drive the transport belts 46. Simultaneously with the actuation of motor 44, solenoid 156 is actuated to pull the lower end of the crank plate 148 toward the rear of the feeder, thereby moving fingers 130 away from the transport path and moving pressure rollers 138 into engagement with drive rollers 137 to propel the sheet along the transport path. The freewheeling construction of feeder assembly feed rollers 86 and 88 readily permits the transport assembly 30 to pull the trailing portion of the fed original from the feeder assembly 58. Preferably, to prevent possible jamming, the linear speed of the transport belts 46, which is about 1 meter per second, should be somewhat greater than that of the feed rollers 86 and 88.

Upon emerging from the lower end of the cylindrical guide 128, the original follows a path defined from below by the exposure platen 20 and rear edge plate 160 and from above by a guide plate 162 mounted between side plates 22, 23 parallel closely spaced relationship with the imaging platen 20. Guide plate 162 extends over the exposure platen 20 and edge plate 160 and has a plurality of fingers 164 extending generally upwardly and rearwardly between drive rollers 137 and pulleys 42 to ensure that the original is fed under the guide plate 162.

Respective front and rear pressure rollers 166 and 168 disposed above the inner belts 46 maintain the original in a close contacting relationship with the imaging platen 20 as the original advances across the platen's upper surface. We rotatably mount each of the rollers 166 and 168 in a roller support 170 carried by a rod 172 extending from a block 174.

A shaft 178 transversely arranged between side plates 22 and 23 rotatably supports the front roller blocks, while rod 56 supports the rear roller blocks. Rollers 166 and 168 are thus biased against the belts 46 by the weight of the roller supports 170. Rods 172 are loosely retained by screws 176 within blocks 174 to help equalize the force on adjacent belts.

A housing 180 in front of platen 20 receives a multi-fingered gate 182 which may be moved into the transport path followed by the original to stop it for copying. A solenoid 184 shown in FIG. 3 coupled to the gate 182 is actuated to move the gate 182 from a normal blocking position into a nonblocking or retracted position.

The original is moved along the platen 20 by the transport belts 46 until the leading edge of the original abuts the gate 182 and further forward movement is prevented. The transport belts 46 then slip relative to the original while at the same time providing a gentle force which aligns the leading edge of the original against the fingers if it has become skewed.

With the original in place, the optical scanning system (not shown) of the copier 12 is actuated to produce the desired number of copies. When the exposure portion of the last copying cycle is complete, the solenoid 184 is actuated to retract the gate fingers from the transport path to allow the original to be advanced to the tray 206. A guide 186 having fingers 188 extending rearwardly and upwardly between adjacent belts 46 ensures that the original is separated from the belts and is not carried around the pulley assembly 32. The fingers 188 are recessed in notches (not shown) provided on the underside of guide bar 54. The original moves along an upwardly curved guide 190 into the tray 206. For this purpose, pulley assembly 32 is arranged so that the trained portions of the belts 46 are tangent to the surface of the guide 190. A plurality of drive rollers 192 are disposed at a tangent to the inner surface at a location spaced downstream from the belts 46. Belts 46 and rollers 192 engage first and second pluralities of idler rollers 194 and 196, respectively, mounted on the other side of the guide 190. Guide member 190 is provided with slots at suitable locations to permit rollers 194 and 196 to contact belts 46 and rollers 192, respectively. Rollers 192 are mounted on a shaft 198 rotatably received by side panels 22 and 23.

Documents exiting from the upper end of guide 190 at an outlet B enter collection tray 206, disposed between the platform 126 and guide 162. Tray 206 is formed with a depression 208 at its front end to facilitate the removal of documents therefrom and has a front wall 204 the upper end of which is bent forward to shield the rotating parts of the transport assembly 30. A transparent cover 210 attached to the front edge of platform 126 by means of hinges 212 serves to direct exiting documents downwardly into the tray 206. Longitudinally extending ribs 214 on the underside of cover 210 prevent the generation of any undersirable electrostatic change on the stacking documents.

The combined operation of the feeder assembly 58 and the transport assembly 30 will now be described in some detail. Before the copier 12 is actuated, feeder assembly motor 104 is energized to advance the uppermost original from the stack S through the inlet A past the pressure rollers 138. At this point, feeder assembly motor 104 is de-energized, while transport assembly motor 44 and solenoid 156 are energized to move the pressure rollers 138 against drive rollers 137 to move the original along the transport path onto the exposure platen 20. One-way clutch 90 permits rollers 86 and 88 to be overdriven by rollers 138 and 137. Transport assembly motor 44 remains energized until a short period after the leading edge of the original abuts the fingers of the exit gate 182 to realign the original if it has become skewed.

With the original in place on the platen 20, the scanning system of the copier 12 is actuated to make the desired number of copies. At the end of the last exposure, solenoid 184 is actuated to retract the exit gate 182 and transport assembly motor 44 is reactuated to move the original along guide 190 into the tray 206. Simultaneously with the advance of the first original, feeder assembly motor 104 is reactuated to advance a second original through inlet A to feed it to rollers 137 and 138. The operation of assemblies 58 and 30 is now repeated in cyclical fashion, with successive originals being advanced to and removed from the exposure platen 20 between the exposure portions of successive copying cycles. The operation is continued until all of the originals have been advanced past the exposure platen 20.

Referring now to FIG. 3, we show an exemplary control circuit for our automatic feeder. Before making any copies, the operator activates a suitable selector circuit 216 to load a signal representing the number of originals into a digital counter 218. Counter 218, which counts down one in response to a positive-going signal supplied to a clock pulse (CP) input, provided an AND gate 220 with a 1 or "high" logic signal whenever the count is greater than zero. After placing a stack of originals face up on the support 64, the operator momentarily closes a "print" switch 222 to initiate the feeding cycle. Closure of switch 222 supplies a "high" logic signal from a line 224 to one input of an OR gate 226 to provide a 1 or "high" logic signal to the other input of AND gate 220. AND gate 220 then sets an RS-type flip-flop 228 to logic level 1 to provide a "high" output to a noniverting driver 230. Driver 230 drives a coil of a single-pole normally open relay 232 to connect the feeder assembly motor 104 between AC supply lines 234 and 236.

In the manner described previously, motor 104 drives feed rollers 86 and 88 to advance the uppermost original in the stack S through the inlet A until the leading edge of the original actuates a microswitch S1 disposed just beyond the pressure rollers 138. Closure of switch S1 applies a positive voltage from line 224 to one input of an OR gate 238 to provide a high, or positive, input to a non-inverting driver 240. Driver 240 drives the coil of a double-pole normally open relay 242 which controls both the transport assembly motor 44 and the solenoid 156. As a result, the belts 46 of the transport assembly are driven while, simultaneously, fingers 130 are retracted and pressure rollers 138 are moved into engagement with the original to move it along the transport path. A delay circuit 244 coupled between switch S1 and the reset (R) input of flip-flop 228 delays the leading edge of the switch signal so that, a short time interval after the switch S1 is closed, flip-flop 228 is reset to provide a 0 or "low" logic output, disabling feeder motor 104.

As the leading edge of the original moves beyond rollers 138, it engages a microswitch S2 disposed near the lower end of the guide 128. As a result, the potential from line 224 is applied through switch S2 to a second input to OR gate 238 so that the motor 44 and the solenoid 156 remain energized after the trailing edge of the original has moved past switch S1. Switch S2 is also coupled to the input of a delay circuit 246 to provide an output with a delayed trailing edge to a third input to OR gate 238. OR gate 238 thus remains at logic level 1 for a short time after the trailing edge of the original has cleared switch S2 to ensure that the belts 46 move the leading edge of the original against the fingers of the exit gate 182. After a short time interval, delay circuit 246 provides a "0" output to OR gate 238, disabling the transport assembly motor 44 and the solenoid 156. The output of OR gate 238 is also applied through a logic inverter 248 to a one-shot multivibrator 250. When motor 44 and solenoid 156 are disabled, one-shot multivibrator 250 provides a pulse to the scanning control circuit 252 of the copier 12, initiating the copying operation. Multivibrator 250 also provides a pulse to counter 218 through delay circuit 272, causing it to count down one.

After the first or any succeeding original except the last has been copied one or more times, the original is advanced to the stacking tray 206 while a new original is advanced from the top of the stack S to the exposure platen 20. To this end, momentary actuation of a line 254 by copier logic 252 at the end of the copying cycle provides pulse inputs to OR gates 226 and 256. As a result, flip-flop 228 is again set to energize the feeder motor 104 to advance a second original from the stack S. At the same time, OR gate 256 drives the input of a driver 258 coupled to a normally open relay 260. The contacts of relay 260 are coupled to the exit gate solenoid 184. OR gate 256 also drives one input of an OR gate 262 directly and another input through a further delay circuit 264. Gate 262 drives a relay 266, controlling transport assembly motor 44, through a driver 268.

Thus, after an original has been copied, the exit gate 182 is retracted to permit further movement of that original along the transport path while motor 44 is energized to drive the transport belts 46. Line 254 continues to supply the pulse to OR gate 256 for a sufficient period of time to allow the leading edge of the first original to trip an exit switch S3 disposed just beyond the exit gate 182. When the first original trips switch S3, the potential from line 224 is applied through that switch to a second input to OR gate 256 so that the motor 44 and the solenoid 184 remain energized.

Switch S3 is coupled through a delay circuit 270 to a third input of OR gate 256. Circuit 270 delays the negative-going edge of its input so that, a short period after the trailing edge of the first original clears switch S3, the output of delay circuit 270 changes to zero to produce a zero output from OR gate 256. As a result, solenoid 184 is disabled. Motor 44 remains energized, however, since by this time the second original has advanced far enough to trip microswitch S1 in the manner described before. Delay circuit 270 has a time constant such that, by the time its output changes to zero, the trailing edge of the first original has cleared the exit gate 182, but the leading edge of the second original has not yet reached that point. Motor 44 thus advances the second original into place for copying while at the same time advancing the first original to the stacking tray.

The process as described above is repeated until all of the originals have been copied. When the last original is fed to the exposure platen 20 to make one or more copies, counter 218 counts to zero and disables AND gate 220 so that the feed motor 104 remains unactuated by the pulse on line 254 when the last original is advanced to the stack tray. In response to that pulse, however, transport motor 44 remains energized for a sufficient period of time, as determined by delay circuits 270 and 264, to advance the last original to the tray 206. One-shot multivibrator 250 does not produce a pulse at this time, though, since intake switches S1 and S2 are not actuated.

While they do not as such form a part of the present invention, further details of the construction and operation of the transport assembly 30 and associated control circuit may be found in copending application of T. Hori, Ser. No. 884,999, filed Mar. 9, 1978, owned by the assignee herein, now U.S. Pat. No. 4,231,562.

Figure 5:
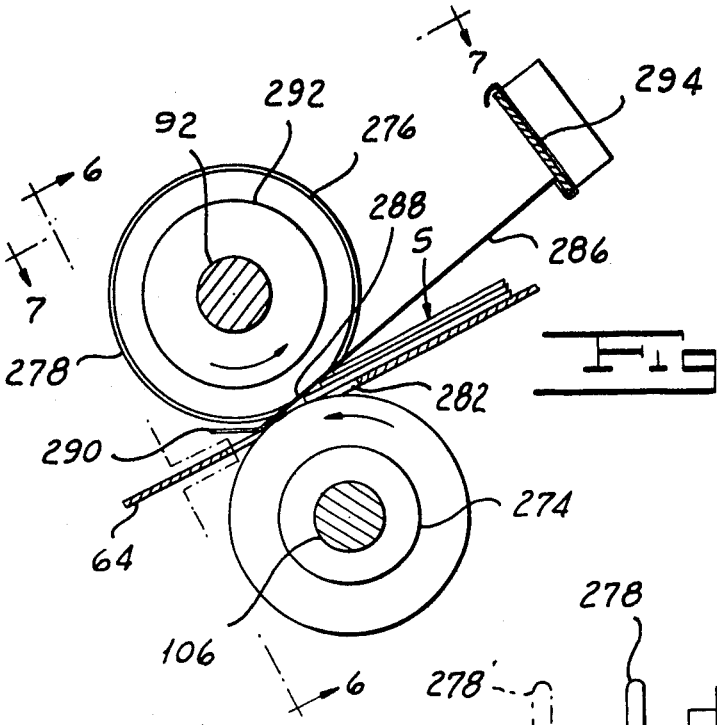
FIG. 5 is a fragmentary section of an alternative embodiment of our automatic document feeder which feeds sheets from the bottom of the stack.
Figure 6:
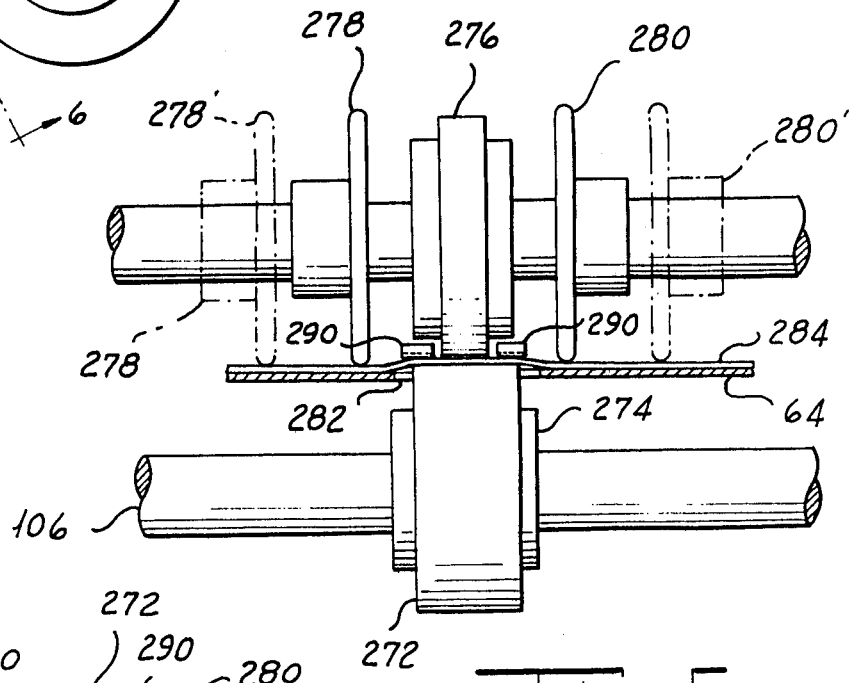
FIG. 6 is a fragmentary section of the alternative embodiment shown in FIG. 5, taken along line 6—6.
Figure 7:
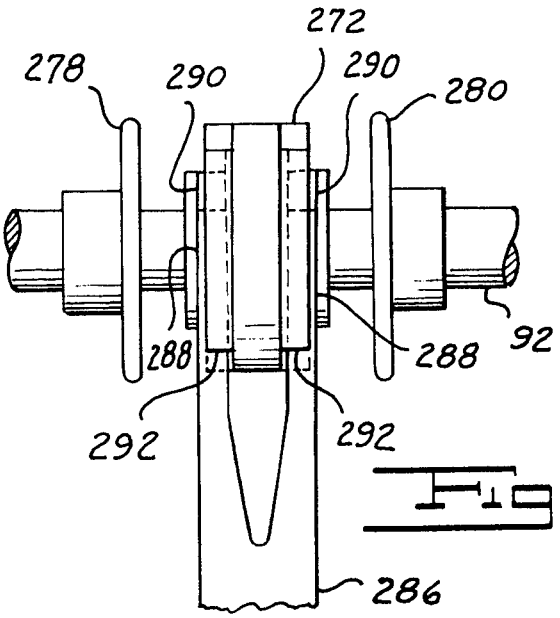
FIG. 7 is a fragmentary view of the alternative embodiment shown in FIG. 5 as seen along line 7—7.

Referring now to FIGS. 5 to 7, we show a preferred form of our invention in which the feed roller is disposed below the retarding roller to feed sheets from the bottom of the stack S and thus allow the sheets to be deposited in the tray 206 in their original stacking order. More particularly, referring now to the drawings, shaft 106 supports a high-friction rubber feed roller 272 extending through an opening 282 in base 64. Upper shaft 92 supports a lower-friction rubber retarding roller 276 of about the same hardness as roller 272. Rollers 272 and 276 are in axial registry with each other and are radially spaced from each other by such a distance as to permit the passage of only one sheet 284 therebetween.

Feed roller 272 is driven in a counterclockwise direction as viewed in FIG. 6 to drive the lowermost sheet 284 through the nip formed by the rollers, while retarding roller 276 is driven in the same rotary direction to oppose the passage of the other sheets in the stack S. To rotate the rollers 272 and 276 in this manner, the same power train as before is used, the direction of drive of motor 104 being reversed and pulley 96 being mounted on shaft 106 rather than on shaft 92. A one-way clutch 274 couples feed roller 272 to shaft 106 to permit free-wheeling counterclockwise motion, allowing the roller 272 to be overdriven when the sheet 284 is taken up by the rear pulley assembly 38.

A pair of low-friction metal or plastic scalloping wheels or discs 278 and 280 mounted outboard of roller 276 on shaft 92 and having a slightly greater diameter than that of roller 276 "scallop" the sheet 284 slightly as shown in FIG. 6 to prevent the leading edge of sheet 284 from curling over as it clears rollers 272 and 276 and to increase the effective frictional force exerted by roller 272. Preferably, scalloping wheels 278 and 280 have rounded edges as shown in FIG. 5 and are adjustable axially to accommodate sheets 284 of various weights or stiffnesses.

To ensure further the reliable feeding of originals of various thicknesses from the stack S, we employ a leaf spring 286 supported by a bracket 294 extending between sidewalls 60 and 62 above the region of the stack S. Leaf spring 286 is formed with fingers 288 that extend between feed roller 272 and reduced portions 292 of retard roller 276 to bear against the upper surface of the feed roller 272. Fingers 288 have end portions 290 extending upwardly away from roller 272 to avoid interference with the sheet 284 being fed, while the lower surface of spring 286 is preferably provided with a low-friction coating (not separately shown), such as one of the tetrafluoroethylene polymer available from E. I. duPont deNemours & Co. under the trademark TEFLON, to reduce friction between the sheet 284 and the fingers 288.

Fingers 288 urge the lowermost sheet 284 into frictional engagement with feed roller 272, ensuring its feed from the stack S even if the thickness of the sheet 284 is such as to prevent it from being effectively gripped in the nip formed by rollers 272 and 276. In this manner, the feeder shown in FIGS. 5 to 7 can effectively handle sheets of varying thickness without readjusting the relative spacings of rollers 272 and 276.

It will be seen that we have accomplished the objects of our invention. Our document feeder is capable of operating in either a semiautomatic or a fully automatic mode, while at the same time being simple and reliable. Further, our feeder permits a fast overall copying ratio and readily handles sheets of varying thicknesses.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. Document transport apparatus for use with a copier having an imaging station, said apparatus including in combination means forming an inlet for receiving documents, means forming a generally horizontal guide surface facilitating manual introduction of documents into said inlet, a document support for receiving a stack of documents, said support having an end, means for automatically advancing documents from said end of the support, means mounting said support and said advancing means for constrained movement between first and second limit positions relative to said inlet-forming means and said guide surface while remaining continuously attached thereto, said support and said advancing means overlying said guide surface in said first limit position with said end adjacent said inlet and overlying said inlet in said second limit position to expose said guide surface and permit manual introduction of a document into said inlet, said advancing means being operative in the first position to introduce documents from said support into said inlet, and means operable in each of said positions of said support and said advancing means for transporting a document introduced into said inlet to said imaging station.

2. Apparatus as in claim 1 wherein said support and said advancing means are mounted for rotation about an axis adjacent said inlet between said first and second positions.

3. Document transport apparatus for use with a copier having a transparent exposure platen on which documents are stopped for copying, said apparatus including in combination means forming an inlet for receiving documents, means forming a generally horizontal guide surface facilitating manual introduction of documents into said inlet, a document support for receiving a stack of documents, said support having an end, means for automatically advancing documents from said end of the support, means mounting said support and said advancing means for constrained movement between first and second limit positions relative to said inlet-forming means and said guide surface while remaining continuously attached thereto, said support and said advancing means overlying said guide surface in said first limit position with said end adjacent said inlet and overlying said inlet in said second limit position to expose said guide surface and permit manual introduction of a document into said inlet, said advancing means being operative in the first position to introduce documents from said support into said inlet, means operable in each of said positions of said support and said advancing means for transporting a document introduced into said inlet to said exposure platen, and means for holding said document stationary on said platen for a period sufficient to permit optical scanning of the document.

4. Apparatus as in claim 3 wherein the guide surface overlies the platen.

5. Apparatus as in claim 3 wherein the guide surface overlies the platen, further including means mounting the guide surface and the document support for concomitant movement to a position exposing said platen to permit placement of a thick document thereupon.

* * * * *